US009167647B1

(12) United States Patent
Takekawa et al.

(10) Patent No.: US 9,167,647 B1
(45) Date of Patent: Oct. 20, 2015

(54) CONTROL CIRCUIT AND CONTROL METHOD FOR DIMMING A LIGHTING DEVICE

(71) Applicant: Spansion LLC, Sunnyvale, CA (US)

(72) Inventors: Koji Takekawa, Kanagawa (JP); Kazuyoshi Arimura, Aichi (JP)

(73) Assignee: Cypress Semiconductor Corporation, San Jose, CA (US)

( * ) Notice: Subject to any disclaimer, the term of this patent is extended or adjusted under 35 U.S.C. 154(b) by 0 days.

(21) Appl. No.: 14/315,713

(22) Filed: Jun. 26, 2014

(51) Int. Cl.
*H05B 37/02* (2006.01)
*H05B 33/08* (2006.01)

(52) U.S. Cl.
CPC ..... *H05B 33/0818* (2013.01); *H05B 33/0845* (2013.01)

(58) Field of Classification Search
USPC ..... 315/209 R, 291, 307, 308, 360
See application file for complete search history.

(56) References Cited

U.S. PATENT DOCUMENTS

| | | | | |
|---|---|---|---|---|
| 7,321,203 | B2 | 1/2008 | Marosek | |
| 8,154,222 | B2 | 4/2012 | Korsunsky et al. | |
| 8,198,832 | B2 | 6/2012 | Bai et al. | |
| 8,294,388 | B2 | 10/2012 | Wong et al. | |
| 8,482,225 | B2 * | 7/2013 | Szczeszynski | 315/307 |
| 2006/0279228 | A1 * | 12/2006 | Kato | 315/193 |
| 2012/0074866 | A1 * | 3/2012 | Zhang et al. | 315/291 |

FOREIGN PATENT DOCUMENTS

JP 2011-009366 1/2011

* cited by examiner

*Primary Examiner* — Thuy Vinh Tran

(57) ABSTRACT

A control circuit comprises a power supply unit configured to generate a voltage to be supplied to a load by turning on and off a first switch in response to a drive signal and control a drive current of the load by turning on and off a second switch in response to a control signal, a first controller configured to perform a first PWM control of the drive signal, based on a measurement value of the drive current, a second controller configured to perform a second PWM control of the control signal, based on an external signal, and a synchronous controller configured to synchronize an on-period of one period of the control signal to he a multiple of one period of the drive signal. Further, in the control circuit, during the on-period of the control signal, an inductor current for generating the drive current is cut off for a portion of every period of the drive signal.

6 Claims, 11 Drawing Sheets

First embodiment

CONTROL CIRCUIT AND CONTROL METHOD FOR DIMMING A LIGHTING DEVICE

BACKGROUND OF THE INVENTION

1. Field of the Invention

The present invention relates to a control circuit and method for dimming a lighting device.

2. Background Art

One method for dimming a lighting device or the like is a pulse width modulation (PWM) system that switches on and off a light source such as a light emitting diode (LED) by a pulse signal having a constant frequency and it modulated duty ratio (refer to, for example, U.S. Pat. Nos. 8,294,388, 8,154,222, 8,198,832 and 7,321,203 and Japanese Patent Application Laid-Open No. 2011-9366).

In this PWM system, for example, a direct current-to-direct current (DC-DC) converter, which usually has excellent conversion efficiency, is used as a constant current source and a constant voltage regulator. A duty ratio, which is a ratio of the width of an on state to one period of a drive pulse, i.e., an energizing portion during one period of the drive pulse, is changed to adjust the on/off time, controlling the brightness or luminance of the lighting device.

FIG. 1 is a diagram illustrating a configuration of an example of a PWM dimming control circuit. As illustrated in FIG. 1, is DC-DC convertor 1 is a buck converter, i.e. a converter of step-down type, and functions to cause a constant current to flow through a light source 2, such as an LED, by using a PWM control signal from a constant current controller 4. The constant current controller 4 is connected to a brightness modification unit 3 and a node located at the low side of the light source 2. The constant current controller 4 controls the operation of a switch in the DC-DC converter 1 based on a brightness control signal from the brightness modification unit 3 and a feedback signal indicative of a light emission state of the light source 2.

BRIEF SUMMARY OF THE INVENTION

In a PWM dimming control circuit, such as the one shown in FIG. 1, some of the energy stored in each of an inductor and a capacitor in the DC-DC converter 1 is discharged when the light source 2 is turned off. Therefore, a power loss occurs, resulting in an increase in power consumption from a power supply.

Further, the dimming control method needs to rapidly store energy in the inductor and the capacitor such that, when the light source 2 is about to be turned on, the output current of the DC-DC converter 1 reaches a constant and stable value in a short time to turn on the light source 2. Therefore, high-frequency switching in the PWM control of the DC-DC converter 1 is required. When such high-frequency switching is performed, a power loss in the switch is not negligible, resulting in a further increase in power consumption from the power supply.

The disclosed technique provides a control circuit and method capable of reducing power consumption in PWM dimming.

A control circuit in one aspect of the disclosed technique has a power supply unit, which includes a first switch that turns on and off in response to a drive signal, and a second switch that turns on and off in response to a control signal. The control circuit generates a voltage to be supplied to a load by the turning on and off the first switch and controls a flow of a drive current to the load by turning on and off the second switch.

The control circuit further has a first controller that performs a first PWM control using the drive signal based on a measured drive current, a second controller that performs a second PWM control using the control signal based on an external signal, and a synchronous controller that synchronizes an on-period of one period in the control signal to be a multiple of one period in the drive signal.

Further, in the control circuit, during the on-period of the control signal, the current flowing through the inductor goes to zero for a portion of every period of the drive signal. In other words, inductor current does not flow continuously but discontinuously.

BRIEF DESCRIPTION OF THE DRAWINGS/FIGURES

Embodiments of the invention will now be described, by way of example only, with reference to the accompanying schematic drawings in which corresponding reference symbols indicate corresponding parts. Further, the accompanying drawings, which are incorporated herein and form part of the specification, illustrate embodiments of the present invention, and, together with the description, further serve to explain the principles of the invention and to enable a person skilled in the relevant arts(s) to make and use the invention.

Figure 1:
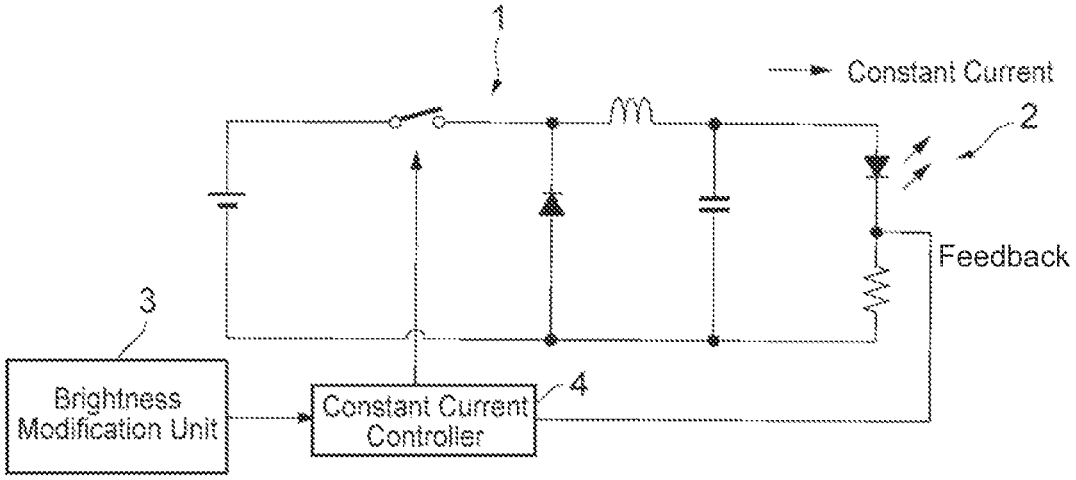
FIG. 1 is a diagram schematically illustrating a configuration of an example of a PWM dimming control circuit.

FIGS. 11A-D are example circuits illustrating other example DC-DC converter topologies applicable to embodiment of a control circuit of the present invention.

DETAILED DESCRIPTION OF THE INVENTION

In the following detailed description, reference is made to the accompanying drawings, which form a part hereof. In the drawings, similar symbols typically identify similar components, unless context dictates otherwise. Further, the drawings are intended to be explanatory and may not be drawn to scale. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

In other words, the following embodiments are illustrated for describing the present invention, and the present invention is not limited to the embodiments. Furthermore, the present invention can be modified in various ways insofar as they do not deviate from the scope of the invention. Moreover, a positional relation such as up, down, left and right may be based on the positional relation as is illustrated in the drawings, unless otherwise specifically indicated. A dimensional ratio in the drawings is not limited to the shown ratio.

First Embodiment

Figure 2:
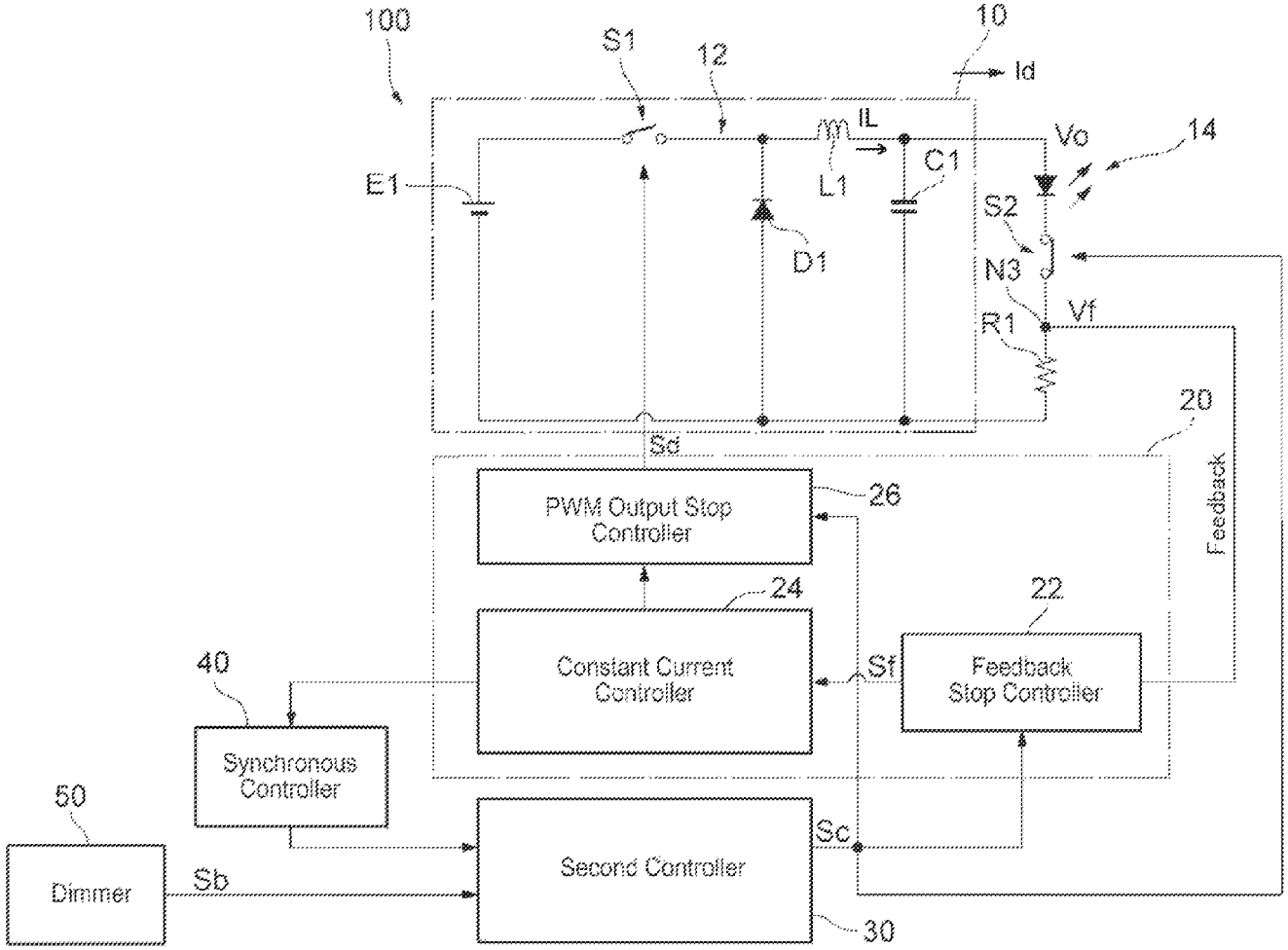
FIG. 2 is a diagram schematically illustrating a configuration of an example of a dimming control circuit according to a first embodiment of the present invention.

FIG. 2 is a diagram schematically illustrating a configuration of an example of a dimming control circuit 100 according to a first embodiment of the present invention. As illustrated in FIG. 2, the control circuit 100 includes a power supply unit 10 that supplies power to a load 14 through a DC-DC converter 12, a first controller 20 that performs a first PWM control of the DC-DC converter, a second controller 30 that performs a second PWM control of the load 14, and a synchronous controller 40 that synchronizes the first controller 20 and the second controller 30.

The power supply unit 10 includes a DC power supply E1, and a step-down DC-DC converter 12. The DC-DC converter 12 includes a switch S1, a diode D1, an inductor L1, and a capacitor C1.

As will be described below, the power supply unit 10 is configured to generate an output voltage Vo to be supplied to the load 14, based on the voltage of the DC power supply E1 by turning on/off the switch S1 and control the flow of a drive current Id to the load 14 by turning on/off the switch S2.

The switch S1 connected in series with the circuit of the DC-DC convertor 12 is controlled based on a drive signal Sd, which is a PWM signal from the first controller 20. More specifically, the switch S1 is turned on in response to a drive signal Sd of a high (H) level and turned off in response to a drive signal Sd of a low (L) level. When the switch S1 is turned on, the current flowing through the inductor L1 increases, increasing the energy stored in the inductor L1. When the switch S1 is turned off, the current flowing through the inductor L1 decreases, discharging the energy stored in the inductor L1 to the output side. Step-down of the voltage of the DC power supply E1 is performed by such on/off control of the switch S1. The output voltage Vo supplied to the load 14 is smoothed by the capacitor C1.

The load 14 includes, for example, one or more LEDs connected in series.

The switch S2 connected in series with the cathode of the load 14 is controlled based on a control signal Sc, which is a PWM signal from the second controller 30. More specifically, the switch S2 is turned on in response to a control signal Sc of an H level and turned off in response to a control signal Sc of an L level. When the switch S2 is turned on, a drive current Id flows through the load 14 so that the LED emits light with brightness corresponding to the drive current Id. The drive current Id is determined by the output voltage Vo, the forward voltage of the LED and the voltage across a resistor R1. Since the drive current Id does not flow when the switch S2 is turned off, the LED stops light emission. Thus, the LED of the load 14 is PWM-driven via the switch S2 controlled by the control signal Sc from the second controller 30.

Here, the period during which the LED is emitting light corresponds to a period during which the control signal Sc is at an H level, i.e., an energizing period. The period during which the LED stops light emission corresponds to a period during which the control signal Sc is at an L level, i.e., a non-energizing period. The amount of light emitted from the LED changes according to the ratio between an energizing period during which the drive current Id flows through the LED and an non-energizing period during which no drive current Id flows, the ratio being dictated by a duty ratio of the control signal Sc. Accordingly, the amount of the light emitted from the LED of the load 14 can be adjusted by changing the duty ratio of the control signal Sc.

The first controller 20, which performs the first PWM control of the DC-DC converter 12 of the power supply unit 10, includes a feedback stop controller 22, a constant current controller 24, and a PWM output stop controller 26. As will be described below, the first controller 20 is configured to adjust the pulse width of the drive signal Sd outputted to the switch S1 of the DC-DC converter 12, based on a measurement value of the drive current Id flowing through the load 14.

The feedback stop controller 22 is connected to a node N3 between the load 14 and the resistor R1. The feedback stop controller 22 measures, based on a voltage Vf of the node N3, the drive current Id in the energizing period of the LED of the load 14 during which the control signal Sc from the second controller 30 is at the H level and the switch S2 is on. Further, based on the measurement value of the drive current Id, the feedback stop controller 22 outputs a feedback signal Sf to the constant current controller 24.

The constant current controller 24 outputs to the PWM output stop controller 26 a PWM signal for controlling the switch S1 of the DC-DC converter 12, based on the feedback signal Sf in such a manner that the drive current Id coincides with a target current corresponding to desired brightness of the LED. In other words, a constant current control based on the target current is realized. The PWM output stop controller 26 generates a drive signal Sd by outputting the above-described PWM signal, controlled by the control signal Sc.

When the drive current Id stops flowing during the non-energizing period of the of the load 14 in which the control signal Sc from the second controller 30 is at the L level and the switch S2 is off, the voltage Vf of the node N3 is zero and the feedback stop controller 22 stops outputting the feedback signal Sf, controlled by the control signal Sc.

Further, the feedback stop controller 22 holds information of the measurement value of the drive current Id immediately before the LED of the load 14 is turned off. Thus, when the LED is turned on again, the constant current control using the measurement value information of the drive current Id and feedback processing are restarted.

During the non-energizing period of the LED of the load 14, the PWM output stop controller 26 controls the DC-DC converter 12 to prevent charging/discharging of the capacitor C1 in such a manner that, for example, the PWM output stop controller 26 stops the transmission of the drive signal Sd to the switch S1 of the DC-DC converter 12, turning off the switch S1.

The second controller 30, which performs the second PWM control of the load 14, is configured to adjust the pulse width of the control signal Sc, based on an external signal. More specifically, the second controller 30 is connected to a dimmer 50. The second controller 30 receives a brightness signal Sb from the dimmer 50 and outputs to the switch S2 the above-described control signal Sc, controlling the duty ratio of the control signal Sc such that the LED of the load 14 emits light having a brightness corresponding to the brightness signal Sb.

The synchronous controller 40 controls the on-period of the control signal Sc from the second controller 30 to be a multiple of one period of the drive signal Sd from the first controller 20, more specifically the PWM output stop controller 26. That is, the synchronous controller 40 synchronizes the on-period of one period of the control signal Sc to be a multiple of one period of the drive signal Sd.

In the first embodiment, the PWM switching frequency of the DC-DC converter 12, and the value of inductance of the inductor L1 are selected in such a manner that a period during which no current flows through the inductor L1, i.e., a period during which the inductor current IL goes to zero, is generated when the LED is turned on. That is, in the control circuit 100, a period, during which the current IL for generating the drive current Id in the power supply unit 10 is cut off, is generated during part of the on-period of the control signal Sc. An example of the circuit parameters will be described later using FIG. 3. The relation between the drive signal Sd, the control signal Sc, the inductor current IL and an output voltage Vo will be described later using the time series diagram illustrated in FIG. 7.

Figure 3:
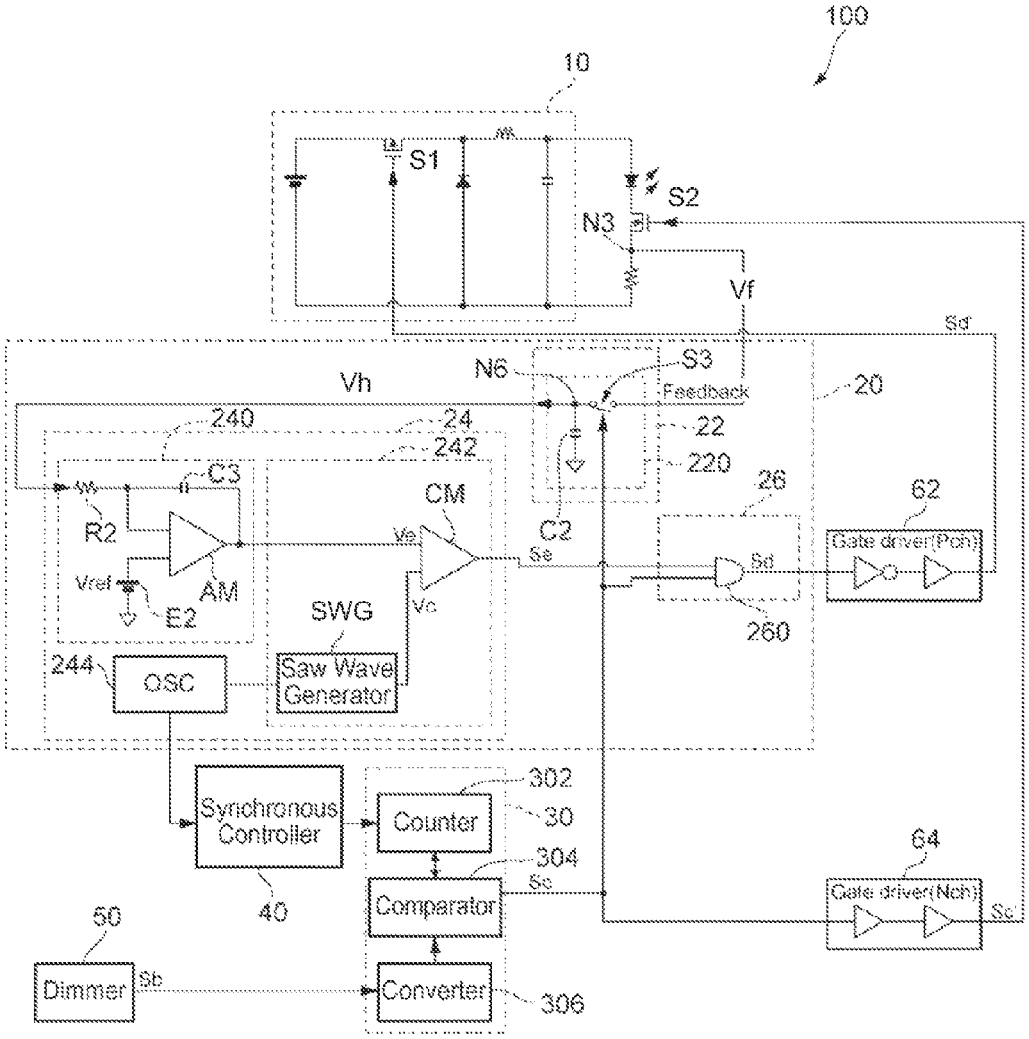
FIG. 3 is a system diagram illustrating an example of a control circuit where a first controller, a second controller, and a synchronous controller in the first embodiment of the present invention are realized by analog circuits.

A description will next be made about an example where the control circuit 100 is realized by analog circuits. FIG. 3 is a system diagram illustrating an example of the control circuit 100 where the first controller 20, the second controller 30 and the synchronous controller 40 in the first embodiment of the present invention are realized by analog circuits. In each circuit illustrated in FIG. 3, the same reference numerals are attached to those that perform functions similar to those illustrated in FIG. 2. Incidentally, the power supply unit 10 is the same as the circuit configuration illustrated in FIG. 2 except that the switches S1 and S2 are both comprised of transistors in FIG. 3.

In the first controller 20, the feedback stop controller 22 includes a sample-hold circuit 220. The sample-hold circuit 220 includes a switch S3 and a capacitor C2. A first terminal of the switch S3 is connected to a node N3, and a second terminal thereof is connected to a first terminal of the capacitor C2. A second terminal of the capacitor C2 is connected to a prescribed ground level, and the first terminal thereof is connected to a resistor R2 of a preamplifier 240.

The switch S3 of the sample-hold circuit 220 is supplied with a control signal Sc from the second controller 30. The switch S3 is controlled in response to the control signal Sc in a manner similar to the switch S2 for driving the load 14. That is, the switch S3 is turned on in response to a control signal Sc of an H level and turned off in response to a control signal Sc of an L level.

When the switch S3 is turned on, a voltage Vf of the node N3 to which the switch S3 is connected is supplied to the capacitor C2. An electric charge based on the voltage Vf is stored in the capacitor C2, so that the voltage of the first terminal becomes equal to the voltage Vf of the node N3. When the switch S3 is turned off, the capacitor C2 is disconnected from the node N3. Accordingly, the capacitor C2 holds the voltage Vf of the node N3 when the switch S3 is turned on and a current Id flows through the load 14. The voltage Vf held by the capacitor C2 in this way is supplied to the preamplifier 240 as a feedback voltage Vh.

The preamplifier 240 includes a resistor R2, a capacitor C3, a reference power supply E2, and an amplifier AM. The amplifier AM is an error amplifier and has a non-inversion input terminal to which a reference voltage Vref is supplied from the reference power supply E2. The reference voltage Vref can be appropriately set according to the peak value of the drive current Id allowed to flow through the load 14. A first terminal of the capacitor C3 is connected to the resistor R2, and a second terminal thereof is connected to the output of the amplifier AM.

The amplifier AM outputs a differential voltage Ve obtained by amplifying a difference voltage between the reference voltage Vref supplied to the non-inversion input terminal and the feedback voltage Vh supplied to an inversion input terminal thereof.

A PWM control unit 242 includes a comparator CM and a saw wave generator SWG that outputs a saw wave-like reference voltage Vc. An input terminal of the comparator CM is supplied with the differential voltage Ve outputted from the preamplifier 240 and the reference voltage Vc outputted from the saw wave generator SWG. The comparator CM compares the differential voltage Ve and the reference voltage Vc and outputs a differential signal Se of a level corresponding to its comparison result. Further, an oscillator (OSC) 244 is a circuit that oscillates an AC signal that serves as a reference tor the saw wave period of the reference voltage Vc.

In the present embodiment, the comparator CM outputs a differential signal Se of an H level during a period in which the differential voltage Ve is higher than the reference voltage Vc, and outputs a differential signal Se of an L level during a period in which the differential voltage Ve is lower than the reference voltage Vc. Accordingly, when the differential voltage Ve falls within the range of the peak voltage of the reference voltage Vc, the differential signal Se is a pulse signal and the pulse width thereof corresponds to the differential voltage Ve. Further, the pulse period thereof becomes the saw wave period of the reference voltage Vc. Thus, the PWM control of the DC-DC converter 12 is performed. Incidentally, when the differential voltage Ve exceeds the range of the peak voltage of the reference voltage Vc, the differential signal Se becomes a prescribed level (H level or L level).

The synchronous controller 40 obtains an output signal from the first controller 20 and controls, based on the output signal, the on-period of a control signal Sc from the second controller 30 to be a multiple of one period of a drive signal Sd from the first controller 20. The synchronous controller 40 outputs a synchronization signal to the second controller 30.

The second controller 30 includes a counter 302, a comparator 304, and a convener 306. The counter 302 performs counting in synchronism with the period of the drive signal Sd from the first controller 20, based on the synchronization signal and outputs a count value to the comparator 304. The converter 306 converts a brightness signal Sb to a duty value and outputs a PWM period value and the duty value to the comparator 304. The comparator 304 compares the count value from the counter 302 to the PWM period value and the duty value from the converter 306. As a result of the comparison, the comparator 304 outputs the control signal Sc at an H level when the count value is not greater than the duty value, and outputs the control signal Sc at an L level when the count value is greater than the duty value. Further, when the count value equals the PWM period value, the comparator 304 clears the count value of the counter 302. Thus, the control signal Sc is a PWM signal whose pulse width corresponds to the brightness signal Sb. The comparator 304 outputs the control signal Sc to a gate driver 64, the switch S3 in the feedback stop controller 22, and an AND circuit 260 in a PWM output stop controller 26.

The PWM output stop controller 26 includes the AND circuit 260. The AND circuit 260 has an input terminal connected to an output terminal of the comparator CM, another input terminal connected to the comparator 304, and an output terminal connected to the gate driver 62. Accordingly, the AND circuit 260 outputs the drive signal Sd corresponding to a result of an AND operation of the differential signal Se and the control signal Sc. Thus, the AND circuit 260 outputs a drive signal Sd of an L level when at least one of the differential signal Se and the control signal Sc is at an L level, and outputs a drive signal Sd of an H level when the differential signal Se and the control signal Sc are both at an H level.

The gate driver 62 is a driver for a P channel field-effect transistor (FET) and has for input the drive signal Sd. An output terminal of the gate driver 62 is connected to the switch S1 comprised of the P channel FET. The gate driver 62 generates a drive signal Sd' having a level that enables the switch S1 to be controlled, with respect to the input drive signal Sd. Since the drive signal Sd is a pulse signal, the drive signal Sd' outputted from the gate driver 62 is also a pulse signal.

The gate driver 64 is a driver for an N channel FET and has for input the control signal Sc. An output terminal of the gate driver 64 is connected to the switch S2 comprised of the N channel FET. The gate driver 64 generates a control signal Sc' having a level that enables the switch S2 to be controlled, with respect to the input control signal Sc. Since the control signal Sc is a pulse signal, the control signal Sc' outputted from the gate driver 64 is also a pulse signal.

An example of circuit parameters set to generate the period during which no current flows through the inductor L1, while the LED is turned on, is shown below. The circuit parameters are however not limited to the following example:

power supply E1: 24 V inductance value of inductor L1: 15 μH output capacitance value of capacitor C2: 10 μF switch period (frequency) of DC-DC converter: 7.5 μs (133.3 kHz)

current value during LED light-on period: 350 mA

In the control circuit 100 according to the first embodiment, as described above and as illustrated in FIG. 3, the first controller 20, the second controller 30, the synchronous controller 40 and the like of the control circuit 100 can be realized by means of analog circuits.

Figure 4:
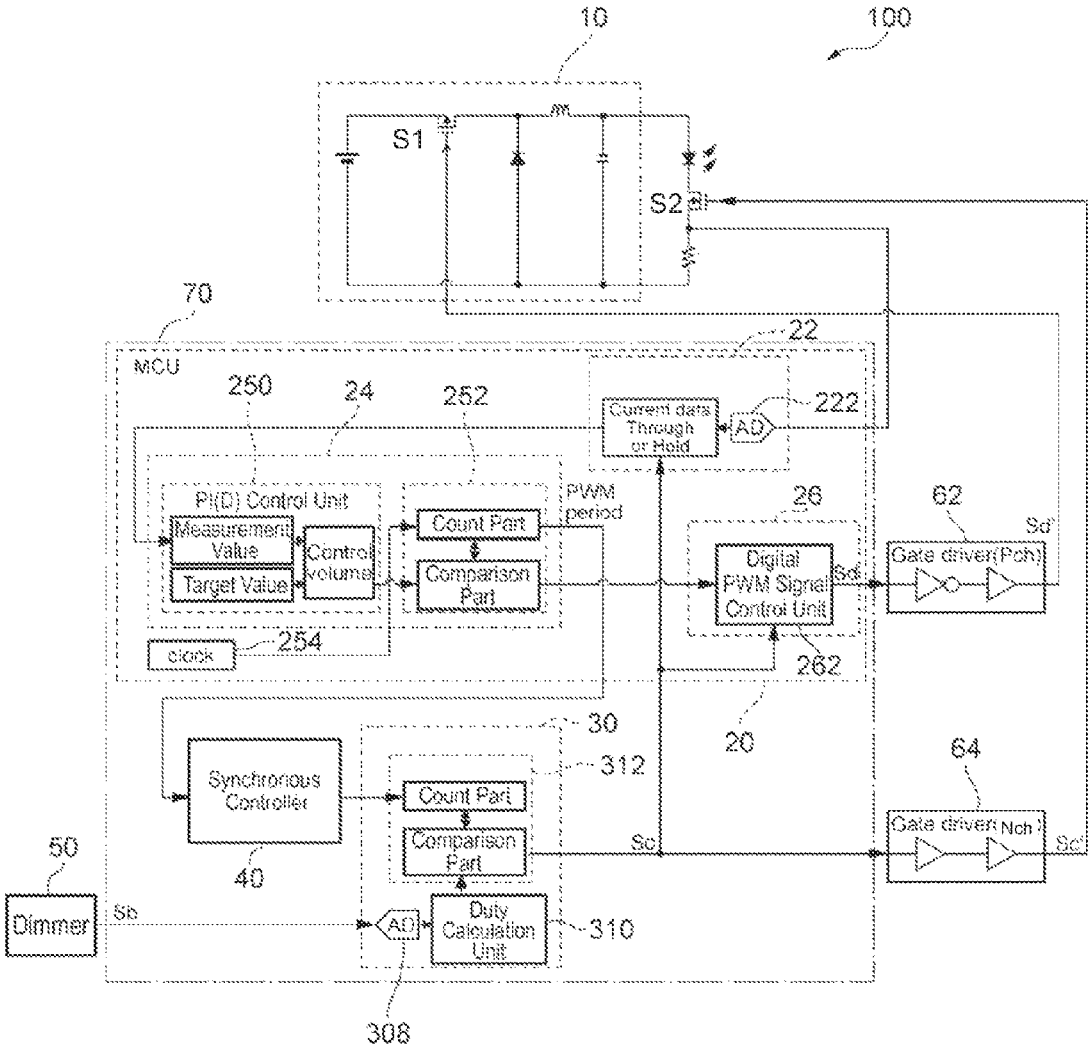
FIG. 4 is a system diagram illustrating an example of a control circuit where the first controller, the second controller, and the synchronous controller in the first embodiment of the present invention are realized by digital control.

A description will next be made about an example where part of the control circuit 100 is realized by digital control. FIG. 4 is a system diagram illustrating an example of a control circuit where the first controller 20, the second controller 30, and the synchronous controller 40 in the first embodiment of the present invention are realized by digital control.

In each circuit illustrated in FIG. 4, the same reference numerals are attached to those that perform functions similar to those illustrated in FIG. 3. The control circuit 100 illustrated in FIG. 4, e.g., a micro controller unit (MCU) 70 executes processing of the first controller 20, the second controller 30, and the synchronous controller 40 by digital control.

In order to perform the digital control inside the MCU 70, the first controller 20 has an analog-to-digital (AD) converter 222 for converting a measurement value of a drive current Id from an analog signal to a digital signal. Further, the second controller 30 has an AD converter 308 for AD conversion of a brightness signal Sb from the dimmer 50.

The feedback stop controller 22 updates, hold and outputs the digitally-converted measurement value to the constant current controller 24. The feedback stop controller 22 illustrated in FIG. 4 is digitally controlled to perform processing equivalent to the sample-hold circuit 220 of the feedback stop controller 22 illustrated in FIG. 3.

The constant current controller 24 includes a PI/PID control unit 250, a digital PWM control unit 252, and a clock 254. The constant current controller 24 receives as input the digitally-converted measurement value of the drive current Id and outputs a signal equivalent to the differential signal Se in FIG. 3. The PI/PID control unit 250 holds a measurement value and a target value and has a volume control part. The PI/PID control unit 250 illustrated in FIG. 4 is digitally controlled to perform processing equivalent to the error comparison unit 240 illustrated in FIG. 3.

The digital PWM control unit 252 has a count part and a comparison part. The digital PWM control unit 252 illustrated in FIG. 4 is digitally controlled to perform processing equivalent to the PWM control unit 242 illustrated in FIG. 3. The clock 254 performs processing equivalent to the OSC 244 illustrated in FIG. 3.

The second controller 30 has an AD converter 308, a duty calculation unit 310, and a digital PWM control unit 312. The duty calculation unit 310 is digitally controlled to perform processing equivalent to the converter 306 illustrated in FIG. 3. The digital PWM control unit 312 is digitally controlled to perform processing equivalent to the counter 302 and the comparator 304 illustrated in FIG. 3.

The PWM output stop controller 26 has a digital PWM signal control unit 262. The digital PWM signal control unit 262 is digitally controlled to perform processing equivalent to the AND circuit 260 illustrated in FIG. 3.

In the control circuit 100 according to the first embodiment as described above, the first controller 20, the second controller 30, the synchronous controller 40 and the like of the control circuit 100 can also be implemented by digital control as illustrated in FIG. 4.

Figure 5:
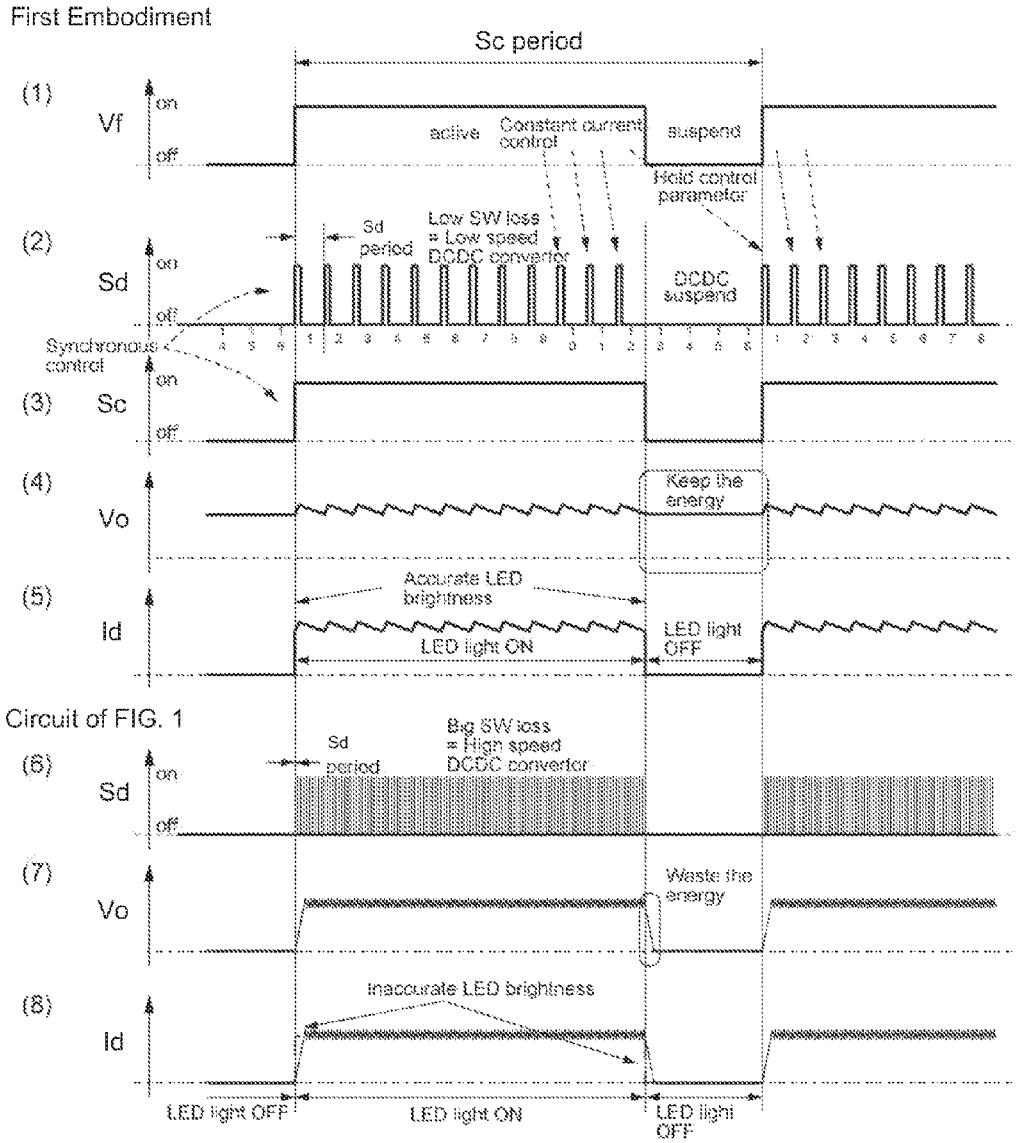
FIG. 5 is a time series diagram illustrating examples of operation of the present invention and the control circuit in FIG. 1.

Comparison Between the Present Invention and the Control Circuit in FIG. 1 With Respect to Output Capacitance and Dimming FIG. 5 is a time series diagram illustrating, by comparison, examples of operations of the present invention and the control circuit in FIG. 1. Numbers (1) to (5) indicate waveforms related to the first embodiment, and numbers (6) to (8) indicate waveforms related to the control circuit in FIG. 1.

FIG. 5 (1) illustrates an example of a waveform indicative of on and off states of the LED, based on the current measured by the feedback stop controller 22. When the LED is turned on, it is "on", and when the LED is turned off, it is "off".

FIG. 5 (2) illustrates an example of the drive signal Sd indicative of on and off states of the switch S1 for the DC-DC converter 12. As illustrated in FIG. 5 (2), one period of the control signal Sc covers sixteen periods of the drive signal Sd. The switch S1 is repeatedly turned on and off during the first twelve Sd periods out of the sixteen Sd periods. During the last four Sd periods, the control of the DC-DC converter 12 is temporarily suspended.

FIG. 5 (3) illustrates an example of the control signal Sc indicative of on and off slates of the switch S2 for dimming, In the example illustrated in FIG. 5 (3), the control signal Sc is synchronously controlled in such a manner that an on-period of one Sc period becomes a multiple (e.g., twelve times) of one period of the drive signal Sd for the DC-DC converter 12.

FIG. 5 (4) illustrates an example of the voltage Vo of the capacitor C1. As illustrated in FIG. 5 (4), the voltage Vo of the capacitor rises or falls with the turning on/off of the switch S1. Further, since no current flows through the inductor L1 when the dimming switch S2 is turned off, the capacitor C1 is kept charged with an electric charge at the time of turning off of the switch S2. Accordingly, the voltage Vo of the capacitor at the time of turning off of the switch S2 is maintained.

FIG. 5 (5) illustrates an example of the LED current that indicates the brightness of the LED. As illustrated in FIG. 5 (5), the LED can be turned on with desired brightness immediately after the switch S2 in FIG. 5 (3) is turned on. Further, immediately after the switch S2 is turned off, the LED cart be turned off.

This LED control is realized by allowing the control circuit 100 to hold the circuit state of the constant current control during the LED light-on period and hold the electric charge of the output capacitance during the LED light-off period. For example, the control circuit 100 holds parameters for the constant current control in FIG. 5 (1) and holds the electric charge of the output capacitance when the LED is turned off during a period described as "Keep the energy" in FIG. 5 (4).

Further, when the LED is turned back on by the control signal Sc, the control circuit 100 restarts the operation of the DC-DC converter 12 in the circuit state of the constant current control, which has been held therein.

FIG. 5 (6) is a waveform illustrating an example of the turning on/off of the switch for the DC-DC converter in the control circuit in FIG. 1. As illustrated in FIG. 5 (6), in the control circuit in FIG. 1, the switching frequency of the PWM signal is much higher than the PWM signal illustrated in FIG. 5 (2). That is, the period of the PWM signal in FIG. 5 (6) is much shorter than the PWM signal in FIG. 5 (2).

FIG. 5 (7) illustrates an example of the voltage Vo of the capacitor of the DC-DC converter in FIG. 1. As illustrated in FIG. 5 (7), in the DC-DC converter in FIG. 1, when the LED is turned off, the capacitor is discharged. Therefore, the voltage Vo of the capacitor drops.

FIG. 5 (8) illustrates an example of the LED current that indicates the brightness of the LED in the control circuit in FIG. 1. As illustrated in FIG. 5 (8), when the LED is turned on, a time period is required for the desired brightness to be reached. Further, even when the LED is turned off, a time period elapsed before the LED is totally turned off.

According to the first embodiment as described above, since the energy stored in each of the inductor and the capacitor is not discharged when the LED is turned off, there is no power loss due to dimming. Further, since turning the LED from on to off and off to on is substantially instantaneous, the proper brightness of the LED can be obtained promptly. Further, since the energy is maintained in the capacitor, a high-speed DC-DC converter necessary to perform recharging in a short period of time becomes unnecessary, thus making it possible to reduce a power loss caused by the switching of the DC-DC converter.

PWM Period for DC-DC Converter and PWM Period for Dimming

Figure 6:
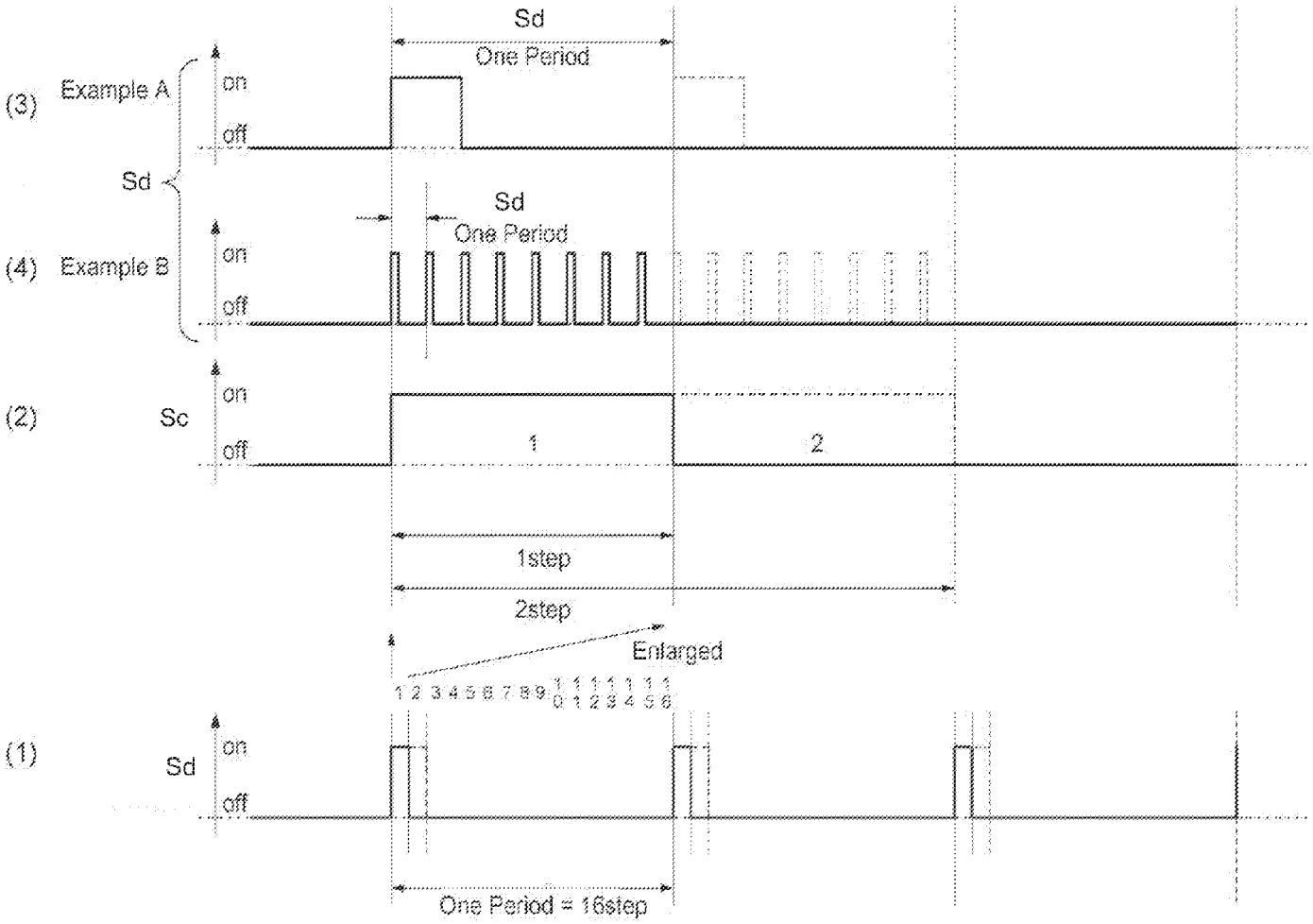
FIG. 6 is a time series diagram illustrating two examples of operation of the present invention.

FIG. 6 is a time series diagram illustrating two examples of operation of the present invention and is, particularly, a diagram illustrating the first PWM control for the DC-DC converter, i.e., the drive signal Sd, and the second PWM control for the LED dimming, i.e., the control signal Sc, in contrast with each other.

FIG. 6 (1) illustrates an example of the whole waveform for the control signal Sc, wherein one Sc period consists of 16 steps. A solid line illustrates a one-step on-period, and an additional broken line illustrates a two-step on-period.

In the case of the one-step on-period, during one Sc period, the LED is turned on for one step, and the LED is turned off for fifteen steps. Therefore, the LED has a brightness of 1/16 of the brightness of the LED if switch S2 were to remain closed.

In the case of the two-step on-period, the LED is turned on for two steps, and the LED is turned off for fourteen steps. Therefore, the LED has a brightness of 2/16 of the brightness of the LED if switch S2 were to remain closed.

FIG. 6 (2) is an example of an enlarged waveform of the vicinity of the first two steps in the whole waveform for the control signal Sc.

FIG. 6 (3) illustrates an example A of the drive signal Sd for the DC-DC convener 12 for the constant current control. In the example A, the synchronous controller 40 synchronizes one step of the control signal Sc with one period of the drive signal Sd.

FIG. 6 (4) illustrates an example B of the drive signal Sd for the DC-DC converter 12 for the constant current control. In the example B, the synchronous controller 40 synchronizes one step of the control signal Sc with eight periods of the drive signal Sd.

Incidentally, the synchronizing frequency may be any multiple of the period of the drive signal Sd. The synchronizing frequency is, however, preferably set to be as small as possible to reduce power loss in the switching of the DC-DC converter 12. In the first embodiment, the scenario illustrated in FIG. 6 (3) is employed.

Relation Between PWM Control, Inductor Current and Output Capacitance

Figure 7:
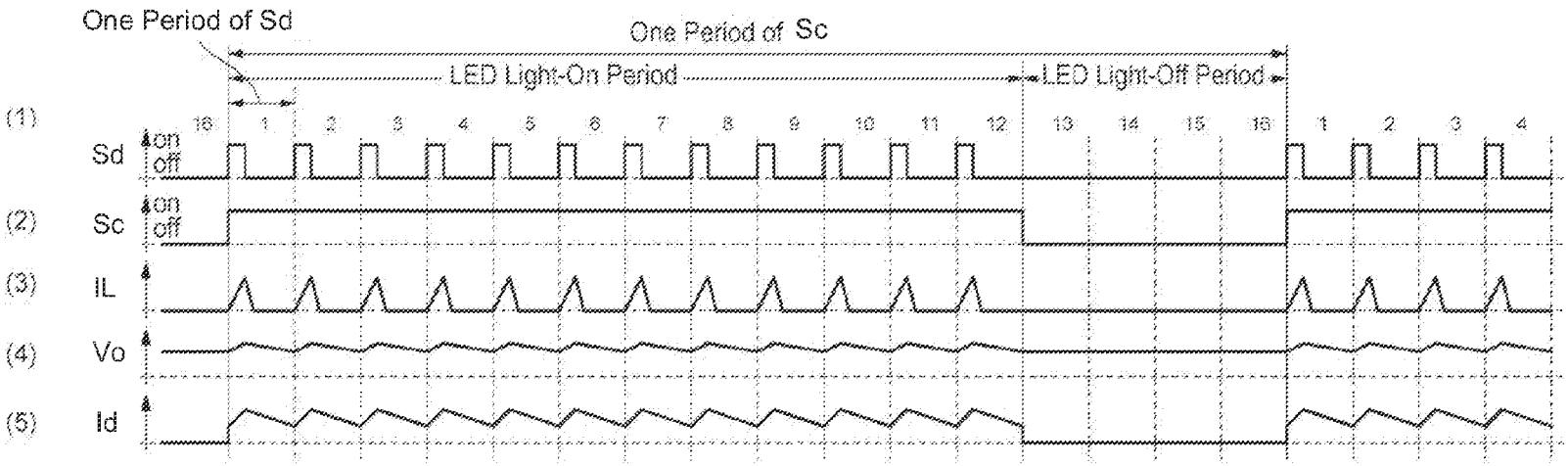
FIG. 7 is a time series diagram illustrating an example of various waveforms in the first embodiment of the present invention.

FIG. 7 is a diagram illustrating various waveforms in the first embodiment. FIG. 7 (1) illustrates an example of the first PWM control for the DC-DC converter 12, i.e., the drive signal Sd. FIG. 7 (2) illustrates an example of the second PWM control for the LED dimming, i.e., the control signal Sc. One period of the control signal Sc illustrated in FIG. 7 (2) consists of sixteen steps The LED light is turned on for twelve steps and off for four steps. Therefore, the brightness of the LED becomes a brightness of 12/16 of the brightness of the LED if switch S2 were to remain closed. The control circuit 100 brings the on-period of the control signal Sc illustrated in FIG. 7 (2) to a multiple of one period of the drive signal Sd for the DC-DC converter 12, which is illustrated in FIG. 7 (1).

FIG. 7 (3) illustrates an example of the waveform of the inductor current. As illustrated in FIG. 7 (3), in regards to the inductor current, while the LED is turned on, the current IL flowing through the inductor L1 goes to zero for a portion of every period of the drive signal Sd. This operation is known as a discontinuous mode for the inductor current IL.

FIG. 7 (4) and FIG. 7 (5) respectively correspond to FIG. 5 (4) and FIG. 5 (5), wherein, when the control signal Sc is off, the inductor current IL goes to zero, and the voltage Vo of the capacitor C1 is maintained. That is, the energy stored in the capacitor C1 is maintained.

During the period from the steps 13 to 16 corresponding to the LED light-off period illustrated in FIG. 7, the feedback stop controller 22 stops the measurement of an LED drive current and feedback control. In preparation for the restart of the LED light-on period, the feedback stop controller 22 holds information of the measurement value of the drive current at the end of the preceding LED light-on period.

The first controller 20 stops the drive signal Sd for the DC-DC converter 12, turning off the switch S1. When the switch S1 is turned off by the first controller 20, the switch S2 is turned off by the second controller 30.

Thus, all paths for the current flowing through the power supply unit 10 are disconnected so that the flow of energy to and from the inductor L1 and the capacitor C1 does not occur. Accordingly, the LED is turned off while the control circuit 100 holds the energy at the end of the LED light-on period.

When the LED is turned back on, i.e., the transition from step 16 to step 1 illustrated in FIG. 7, the second controller 30 restarts the lighting of the LED using the energy stored in the capacitor C1 at the moment that the switch S2 is turned on. Using the energy stored in the capacitor C1 at the start of the LED light-on period does not affect the brightness of the LED during the LED light-on period.

The first controller 20 generates a duty ratio for the drive signal Sd, using the drive current value of the LED, which is held in the feedback stop controller 22 to be used at the start of the LED light-on period.

Further, when the LED is turned off, i.e., for the transition from step 12 to step 13 illustrated in FIG. 7, the second controller 30 turns off the LED at the moment that the switch S2 is turned off.

With such operation, in the control circuit 100, turning the LED from on to off and from off to on occur instantaneously so that the proper brightness is obtained.

Comparison Between First Embodiment and First Alternative Operation

Figure 8:
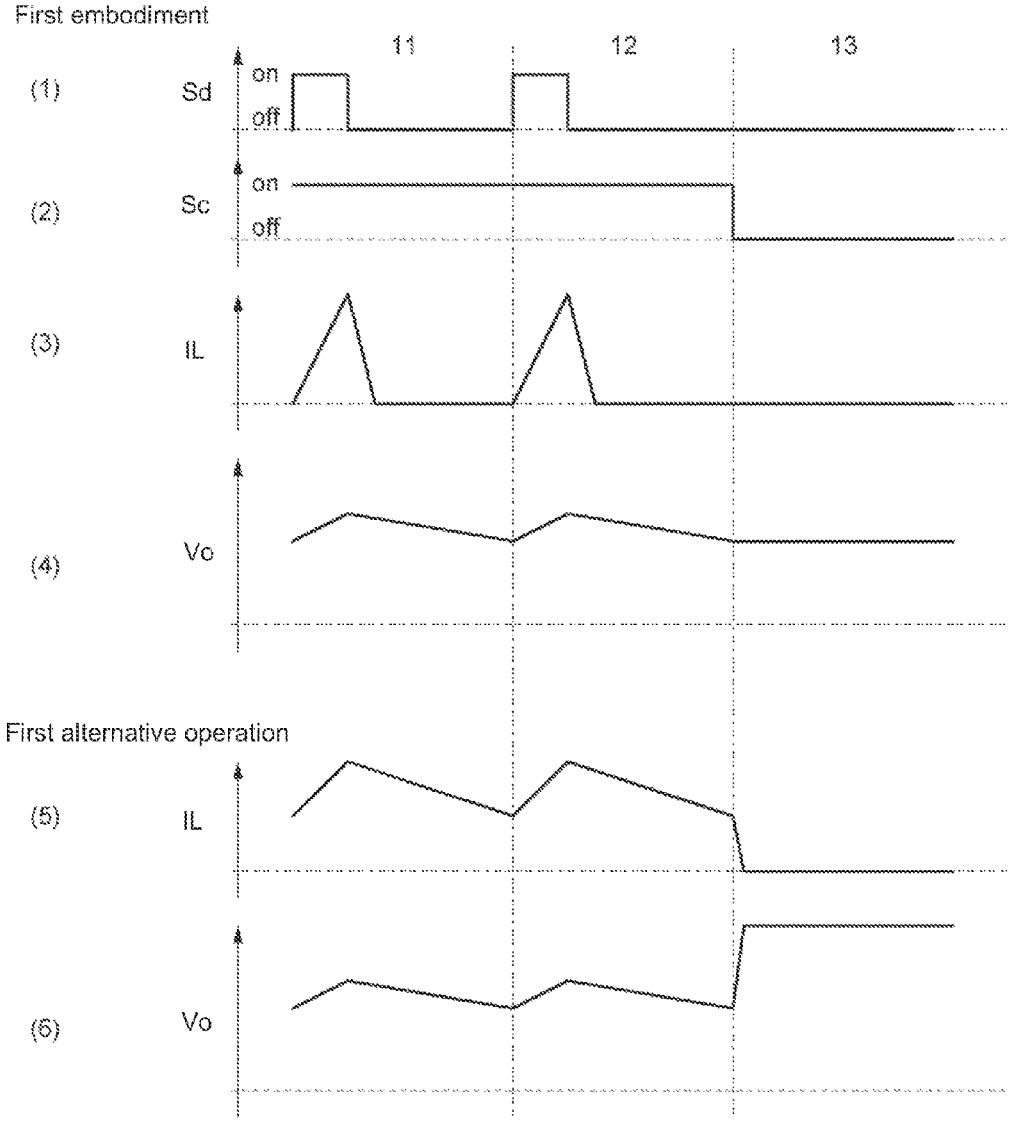
FIG. 8 is a time series diagram illustrating portions of waveforms in FIG. 7 in an enlarged form in comparison with a first alternative operation.

FIG. 8 is a time series diagram illustrating in an enlarged form, portions corresponding to steps 11 and 12 during the LED light-on period and step 13 during the LED light-off period illustrated in FIG. 7 in comparison with a first alternative operation. The first alternative operation is an example in which the current IL continues to flow through the inductor when the switch S2 is turned off (FIG. 8 (5) and FIG. 8 (6)).

In the first embodiment, the current flowing through the inductor L1 goes to zero (FIG. 8 (3)) for a portion of every period of the drive signal Sd (FIG. 8 (1)), when the LED is turned on (FIG. 8 (2)). That is, the inductor current is controlled to be in a discontinuous mode.

The second controller 30 is synchronized with the drive signal Sd by the synchronous controller 40 and switches the dimming switch S2 on and off when the inductor current is zero.

Thus, the switching of the dimming switch S2 from on to off is performed during a period in which no energy is being stored in the inductor L1 and the current IL for generating the drive current Id in the power supply unit 10 is out off. Consequently, the capacitor C1 is capable of maintaining its voltage Vo at the turning off of the switch S2 (FIG. 8 (4)).

On the other hand, in the first alternative operation, a current IL flows through the inductor L1 when the switch S2 is being turned off (FIG. 8 (5)). Consequently, a path for a load current is disconnected while the current IL is flowing through the inductor L1.

Therefore, the inductor current IL flows into the capacitor C1, transferring the energy stored in the inductor to the capacitor C1, causing the capacitor voltage Vo to rise rapidly (FIG. 8 (6)).

Consequently, a problem arises in that an excessive voltage is applied to the capacitor and the LED. Further, since the LED is turned on again when excessive energy has been stored in the capacitor, the LED is turned on with a current value different from the original target current set by the control signal Sc when the switch S2 is turned from off to on, changing the brightness of the LED.

Comparison Between First Embodiment and Second Alternative Operation

Figure 9:
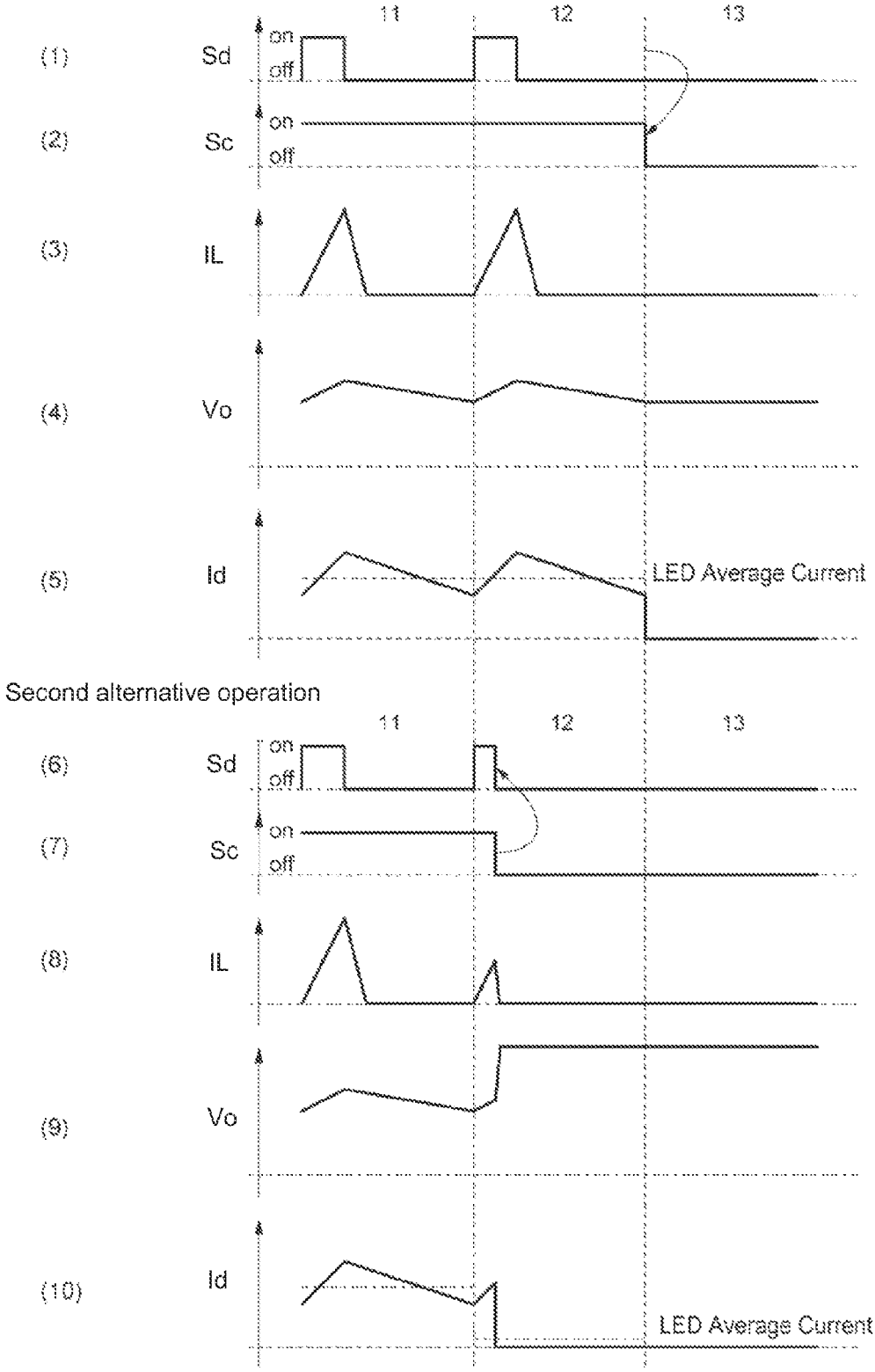
FIG. 9 is a time series diagram illustrating portions of waveforms in FIG. 7 in an enlarged form in comparison with a second alternative operation.

FIG. 9 is a time series diagram illustrating in an enlarged form, portions corresponding to steps 11 and 12 during the LED light-on period and step 13 during the LED light-off period illustrated in FIG. 7 in comparison with a second alternative operation. The second alternative operation is an example in which the drive signal Sd is synchronized with the control signal Sc (FIG. 9 (6) to FIG. 9 (7)), unlike the control signal Sc being synchronized with the drive signal Sd in the first embodiment.

In the first embodiment, the synchronous controller 40 synchronizes the control signal Sc with the drive signal Sd. When the current of the inductor L1 is zero, the synchronous controller 40 turns the switch S2 on and off (FIG. 9 (1) to FIG. 9 (3)).

Thus, the switching of the dimming switch S2 from on to off is performed during a period in which no energy is stored in the inductor L1 and the current for generating the drive current in the power supply unit 10 is cut off. Consequently, the capacitor C1 is capable of maintaining the voltage Vo at the turning off of the switch S2 (FIG. 9 (4)).

Further, since the control signal Sc is synchronized in a multiple of one period of the drive signal Sd, the LED can be turned off without changing the average current of the LED (FIG. 9 (5)).

On the other hand, the second alternative operation illustrates the case where the synchronization direction differs such that the synchronous controller 40 synchronizes the drive signal Sd with the control signal Sc.

In this case, the switch S1 is turned off based on the timing of the switch S2, when the current is flowing through the inductor L1 (FIG. 9 (6) and FIG. 9 (7)).

Thus, a path for a load current is disconnected the current IL is flowing through the inductor L1 at the moment of switching the switch S2 from on to off (FIG. 9 (8)).

Therefore, the inductor current IL flows into the capacitor C1, transferring the energy stored in the inductor to the capacitor C1, causing the capacitor voltage Vo to rise rapidly (FIG. 9 (9)).

Consequently, a problem arises in that an excessive voltage is applied to the capacitor and the LED. Further, since the LED is turned on again when excessive energy has been stored in the capacitor, the LED is turned on with a current value different from the original target current set by the control signal Sc when the switch S2 is turned from off to on, changing the brightness of the LED.

Further, the current flowing through the LED has larger output current ripples. The brightness of the LED is illustrated using average current during one period of the drive signal Sd (FIG. 9 (10)).

Thus, when the DC-DC convener 12 is stopped with an arbitrary timing by the drive signal Sd, the LED is turned on with a current value different from the original target current value, changing the brightness of the LED.

According to the first embodiment as described above, since the discharge of the energy is not performed by making the respective circuits cooperate with each other when the control signal Sc is controlled, it is possible to prevent a power loss from occurring. Thus, according to the first embodiment, it is possible to realize a reduction in power consumption, which is required in LED lighting, for example.

Further, according to the first embodiment, since the LED, being the example of the load 14, can be disconnected while the energy is held by the control circuit 100, it is possible to perform the constant current control of the DC-DC converter 12 in the same state immediately after the connection of the LED.

This means that the LED is turned on again with the target brightness. It is possible to realize dimming while providing proper brightness, a desirable aspect in the LED lighting.

In the first embodiment, the control circuit is capable of operation without problems even using the switching frequency, which is one times as large as the period on one step of the control signal Sc. Thus, according to the first embodiment, since it is possible to reduce a power loss due to switching loss by not using a high-speed DC-DC converter, a reduction in power consumption, which is a desirable aspect in the LED lighting, can he realized.

In the first embodiment as described above, for example, the control method for dimming LED lighting can provide:

very small changes in color tone, a reduction in power consumption by not discharging the energy stored in the inductor and the capacitor during the LED light-off period, proper brightness given that the LED can be turned from on to off and off to on substantially momentarily, and a reduction in power loss due to a reduction in switching loss by not using a high-frequency DC-DC converter.

Second Embodiment

A description will next be made about a circuit control according to a second embodiment. In the second embodiment, the current of an inductor is detected without setting the circuit parameters in advance as in the first embodiment, and a period during which no current flows through the inductor is generated based on the value of the detected current.

Figure 10:
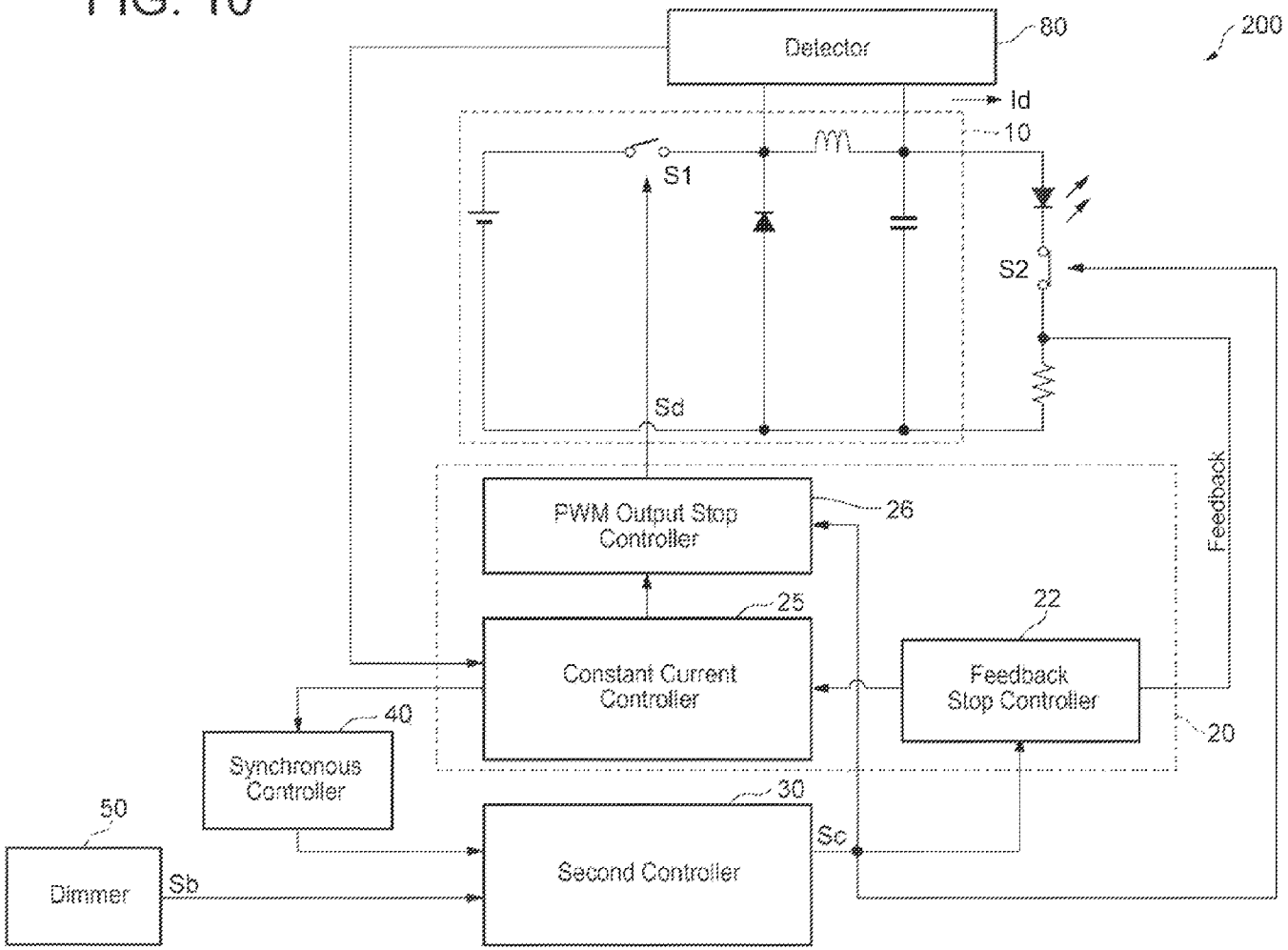
FIG. 10 is a diagram schematically illustrating a configuration of an example of a dimming control circuit according to a second embodiment of the present invention.

FIG. 10 is a block diagram schematically illustrating a configuration of an example of a dimming control circuit according to the second embodiment of the present invention. In the LED dimming control circuit 200 illustrated in FIG. 10, the same reference numerals as those illustrated in FIG. 2 are attached to those used in the first embodiment, and a repetitive description thereof will he omitted. A description will be made below about the parts different from the first embodiment.

A detector 80 is, for example, a detection circuit for detecting a current, which detects the current flowing through the inductor L1. Further, the detector 80 controls the first controller 20 to generate a period during which the current flowing through the inductor L1 becomes 0A.

For example, the detector 80 measures an inductor current in an PWM operation for the DC-DC converter 12, which is controlled by the first controller 20, and detects that the inductor current becomes zero.

The detector 80 controls a period of the drive signal Sd from the first controller 20 in such a manner that the inductor current becomes zero, i.e., the inductor current becomes discontinuous.

Specifically, the detector 80 outputs a control signal to extend the period of the drive signal Sd until the inductor current becomes zero.

The constant current controller 25 obtains a control signal from the detector 80 and detects based on the control signal that the inductor current is zero. Thereafter, the constant current controller 25 generates the drive signal Sd to turn the switch of the DC-DC converter 12 from off to on.

Other means in the second embodiment are similar to the first embodiment. Thus, according to the second embodiment, advantageous effects similar to the first embodiment can be brought about. Further, even in the second embodiment, as illustrated in FIG. 4 and FIG. 5, the control circuit 200 may be implemented by analog circuits or digital control.

Modifications

Figure 11A:
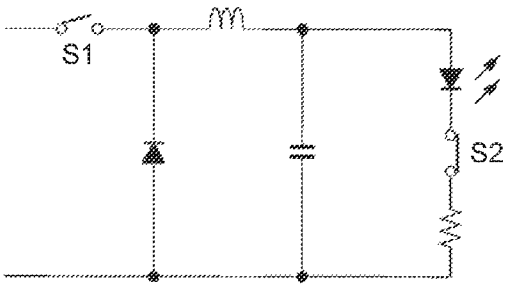
Figure 11B:
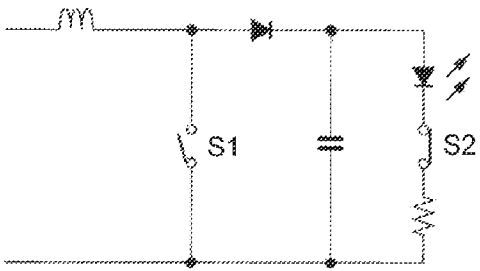
Figure 11C:
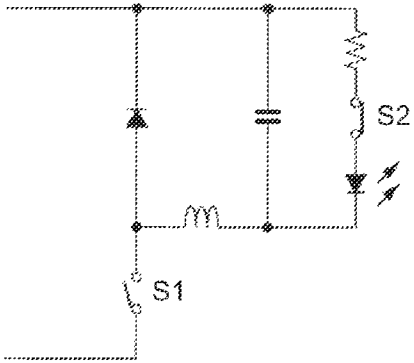
Figure 11D:
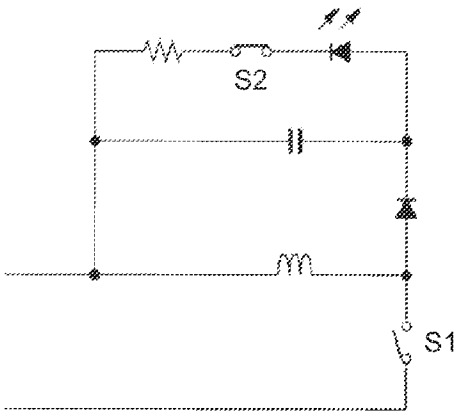

In the present embodiment, in addition to the examples described above, other circuit topologies can be applied to the DC-DC converter 12. FIG. 11A is an equivalent circuit diagram illustrating the DC-DC converter applicable to the control circuit of the present invention. Other circuit topologies such as a step-up circuit (FIG. 11B), a floating type step-down circuit (FIG. 11C), a floating type step-up circuit (FIG. 11D), etc. may be used in place of the step-down circuit (FIG. 11A) illustrated in the first and second embodiments.

Also, substituting the diodes of the circuits illustrated in FIG. 11 with switching elements can allow synchronous rectification.

What is claimed is:

1. A control circuit comprising:

a power supply unit that includes a first switch which is turned on and off in response to a drive signal and a second switch which is turned on and off in response to a control signal, the power supply unit configured to generate a voltage to be supplied to a load by turning on and off the first switch and control a flow of a drive current to the load by turning on and off the second switch:

a first controller configured to perform a first PWM control of the drive signal, based on a measurement value of the drive current;

a second controller configured to perform a second PWM control of the control signal, based on an external signal; and a synchronous controller configured to synchronize an on-period of one period of the control signal to be a multiple of one period of the drive signal, wherein, during the on-period of the control signal, an inductor current for generating the drive current is cut off for a portion of every period of the drive signal.

2. The control circuit of claim 1, wherein circuit parameters including the frequency of the drive signal and an inductance value of an inductor included in the power supply unit are set in such to manner that the inductor current is cut off.

3. The control circuit of claim 1, further comprising a detector configured to detect the inductor current, wherein, when the inductor current is zero, the first controller switches the first switch from on to off.

4. The control circuit of claim 1, wherein, while the second switch is turned off by the second controller, the first controller turns off the first switch to hold parameters related to a constant current control of the drive current.

5. The control circuit of claim 4, wherein, when the second switch is switched from of to on by the second controller, the first controller restarts the first PWM control using the parameters.

6. A control method comprising:

turning on and off a first switch in response to a drive signal to thereby generate a voltage to be supplied to a load and turning on and off a second switch in response to a control signal to thereby control a flow of a drive current to the load;

measuring the drive current and performing a first PWM control of the drive signal, based on a measurement value of the drive current;

performing a second PWM control of the control signal, based on an external signal; and synchronizing an on-period of one period of the control signal to be a multiple of one period of the drive signal, wherein, during the on-period of the control signal, an inductor current for generating the drive current is cut off for a portion of every period of the drive signal.

* * * * *